United States Patent [19]

Iida et al.

[11] Patent Number: 4,875,842

[45] Date of Patent: Oct. 24, 1989

[54] AXIAL FLOW FLUID COMPRESSOR

[75] Inventors: Toshikatsu Iida, Yokohama; Takayoshi Fujiwara, Kawasaki; Tetsuō Fukuda, Yokohama, all of Japan

[73] Assignee: Kabushiki Kaisha Toshiba, Kawasaki, Japan

[21] Appl. No.: 242,217

[22] Filed: Sep. 9, 1988

[30] Foreign Application Priority Data

Sep. 10, 1987 [JP] Japan ..... 62-227320
Jan. 5, 1988 [JP] Japan ..... 63-494

[51] Int. Cl.[4] ..... F04B 39/00
[52] U.S. Cl. ..... 418/220; 417/356
[58] Field of Search ..... 418/220; 417/354, 356; 415/71, 72, 73

[56] References Cited

U.S. PATENT DOCUMENTS 1,295,068 2/1919 Rolkerr ..... 418/220
2,401,189 5/1946 Quiroz ..... 418/220
3,719,436 3/1973 McFarlin ..... 417/356

*Primary Examiner*—Carlton R. Croyle
*Assistant Examiner*—D. Scheuermann
*Attorney, Agent, or Firm*—Cushman, Darby & Cushman

[57] ABSTRACT

A compressor includes a cylinder, and a rotating body located in the cylinder. A spiral groove is formed on the outer periphery of the rotating body. A spiral blade is fitted in the groove and divides the space between the inner periphery of the cylinder and the outer periphery of the rotating body into operating chambers which have volumes gradually decreasing with distance from one end of the cylinder. When the cylinder and rotating body are relatively rotated, a fluid, introduced into the one end of the cylinder, is transported toward the other end of the cylinder through the operating chambers. A pair of bearings rotatably supports both ends of the cylinder and rotatably supports the corresponding ends of the rotating body. One of the bearings is supported by a support mechanism to be movable in the radial direction of the cylinder relative to a closed case which houses the above components therein.

17 Claims, 6 Drawing Sheets

AXIAL FLOW FLUID COMPRESSOR

BACKGROUND OF THE INVENTION

1. Field of the Invention

The present invention relates to a fluid compressor and, more particularly, to a compressor for compressing, e.g., refrigerant gas in a refrigeration cycle.

2. Description of the Related Art

Conventionally know are various compressors, including reciprocating compressors, rotary compressors, and the like. In these compressors, however, the compression section and driving parts, such as a crankshaft for transmitting a rotatory force to the compression section, are complicated in construction, i.e., with many components being used in their construction. For higher compression efficiency, moreover, these conventional compressors should be provided with a check valve on the discharge side thereof. However, the difference in pressure between two opposite sides of the check valve is so great that gas is liable to leak from the valve. Thus, the compression efficiency cannot be high enough. In order to solve these problems, both dimensional and assembling accuracies of the individual parts or components must be improved, which entails an increase in manufacturing costs.

A screw pump is disclosed in U.S. Pat. No. 2,401,189. In this prior art pump, a columnar rotating body, which has a spiral groove on its outer surface, is disposed in a sleeve. A spiral blade is slidably fitted in the groove. As the rotating body is rotated, a fluid, confined between two adjacent turns of the blade in the space between the outer surface of the rotating body and the inner surface of the sleeve, is transported from one end of the sleeve to the other.

Thus, the screw pump serves only to transport the fluid, and is not adapted to compress it. During the transportation, the fluid can be sealed only if the outer surface of the blade is continually in contact with the inner surface of the sleeve. While the rotating body is rotating, however, the blade cannot easily slide smoothly in the groove, due to its susceptibility to deformation. It is difficult, therefore, to continually keep the outer surface of the blade in tight contact with the inner surface of the sleeve. Thus, the fluid cannot be satisfactorily sealed. In consequence, the screw pump of this construction cannot produce any compression effect.

SUMMARY OF THE INVENTION

The present invention has been made in consideration of these circumstances, and has as its object to provide a fluid compressor, having a relatively simple construction for high-efficiency compression, and permitting easier manufacturing and assembling of components.

In order to achieve the above object, a compressor according to the present invention comprises: a cylinder having a suction-side end and a discharge-side end; a columnar rotating body located in the cylinder so as to extend along the axial direction thereof and be eccentric thereto, and rotatable relative to the cylinder while part of the rotating body is in contact with the inner peripheral surface of the cylinder, the rotating body having a spiral groove on the outer peripheral surface thereof, the groove having pitches narrowed gradually with a distance from the suction-side end to the discharge-side end of the cylinder; a spiral blade fitted in the groove so as to be slidable, substantially in the radial direction of the rotating body, having an outer surface in tight contact with the inner peripheral surface of the cylinder, and dividing the space between the inner peripheral surface of the cylinder and the outer peripheral surface of the rotating body into a plurality of operating chambers; a pair of bearings for rotatably supporting both ends of the cylinder and rotatably supporting corresponding ends of the rotating body so as to keep the rotating body at a predetermined position with respect to the cylinder; drive means for relatively rotating the cylinder and the rotating body, thereby introducing a fluid into the cylinder from the suction-side end of the cylinder, and transporting this fluid toward the discharge-side end of the cylinder through the operating chambers; a closed case for housing the constituent members; and support means for supporting one of the bearings to be movable in the radial direction of the cylinder relative to the

BRIEF DESCRIPTION OF THE DRAWINGS

FIGS. 1 to 8H show a fluid compressor according to an embodiment of the present invention, in which FIG. 1 is a sectional view showing an outline of the compressor, FIG. 2 is a side view of a rotating rod, FIG. 3 is a side view of a blade, FIG. 4 is a partially cutaway view of a compressor section of the compressor, FIG. 5 is a sectional view taken along line V—V of FIG. 4, FIG. 6 is an exploded perspective view of a bearing section, FIG. 7 is a front view of the bearing section, FIGS. 8E through 8H are sectional views showing the relationship between a drive rod and a groove in different operating states of the compressor and FIGS. 9 to 11, show a compressor according to another embodiment of the present invention, in which FIG. 9 is a sectional view showing an outline of the compressor, FIG. 10 is a side view of a rotating rod, and FIG. 11 is a side view of a blade.

DETAILED DESCRIPTION OF THE PREFERRED EMBODIMENTS

Embodiments of the present invention will be described in detail with reference to the accompanying drawings.

Figure 1:
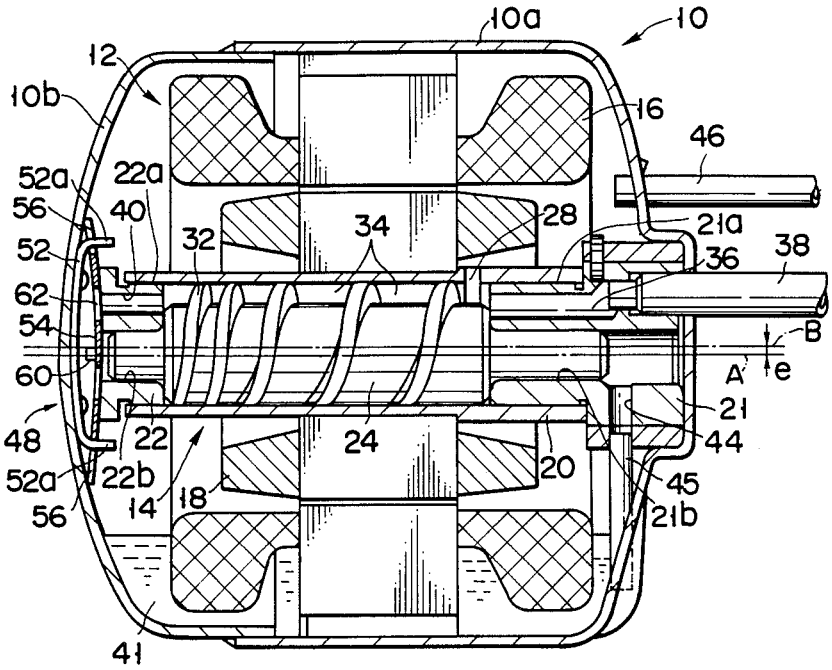
Figure 2:
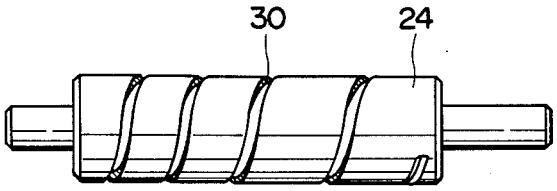
Figure 3:
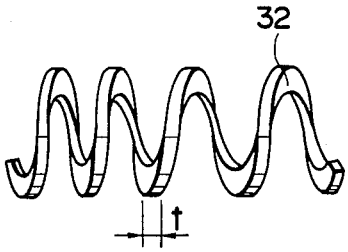

FIG. 1 shows an embodiment wherein the present invention is applied to a compressor for compressing a refrigerant of a refrigeration cycle.

The compressor comprises closed case 10, electric motor section 12, and compression section 14, sections 12 and 14 being located in the case. Closed case 10 includes substantially cup-like large- and small-diameter portions **10*a* and 10*b* and is formed by coupling the opened ends of portions 10*a* and 10*b* to each other. Motor section 12 includes substantially ring-like stator 16 fixed to the inner surface of large-diameter portion 10*a* and ring-like rotor 18** located inside the stator.

Compression section 14 includes cylinder 20, and rotor 18 is coaxially fixed to the outer surface of the cylinder. Both ends of cylinder 20 are closed and rotatably supported by means of their corresponding bearings 21 and 22 which are located in case 10. Especially, the right end of cylinder 20, i.e., the suction-side end, is rotatably fitted on peripheral surface 21*a* of bearing 21, whereas the left end of cylinder 20, i.e., the discharge-side end, is rotatably fitted on peripheral surface 22*a* of bearing 22. Bearing 21 is fixed to the inner surface of large-diameter portion 10*a* of case 10. Bearing 22 i supported on the inner surface of small-diameter portion 10*b* of case 10 by a support mechanism, which will be described later, so as to be movable. Therefore, cylinder 20 and rotor 18 fixed thereto are supported by bearings 21 and 22 to be coaxial with stator 16.

Columnar rotating rod 24, having a diameter smaller than the inner diameter of cylinder 20, is contained in cylinder 20 so as to extend along the axis thereof. Central axis A of rod 24 is located at eccentricity e from central axis B of cylinder 20. Part of the outer peripheral surface of rod 24 is in contact with the inner peripheral surface of cylinder 20. The right and left end portions of rod 24 are rotatably inserted into bearing holes 21*b* and 22*b* formed in bearings 21 and 22, respectively. Bearing holes 21*a* and 22*b* are formed to be coaxial with each other and are located at eccentricity e from the central axis of cylinder 20. With this arrangement, rod 24 is rotatably supported by bearings 21 and 22 at a predetermined position with respect to cylinder 20.

Figure 4:
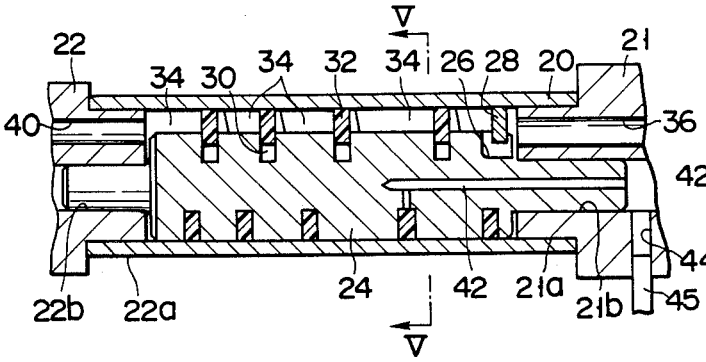
Figure 5:
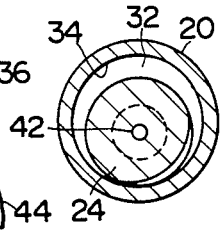
Figure 6:
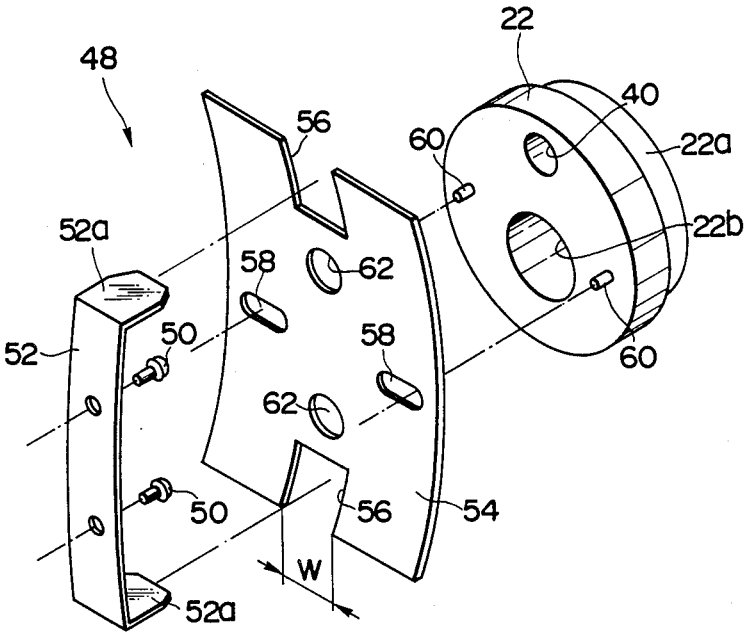
Figure 8A:
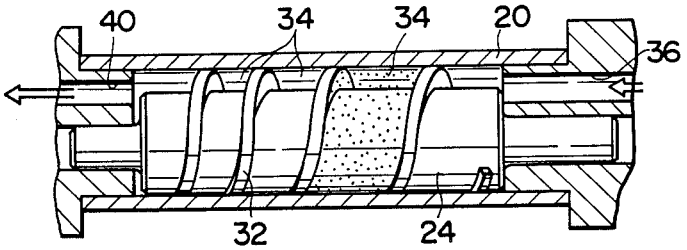
FIG. 8A through 8D are views respectively showing compression processes for refrigerant gas.
Figure 8B:
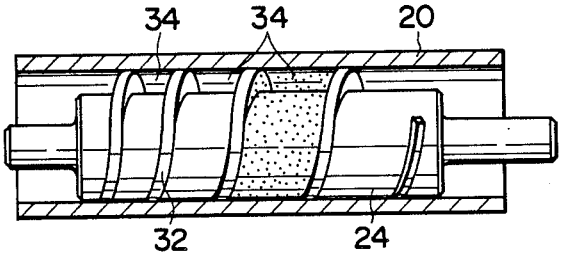
Figure 8C:
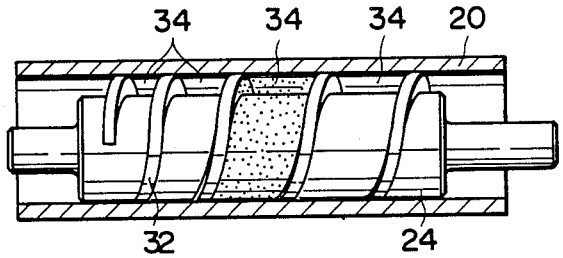
Figure 8D:
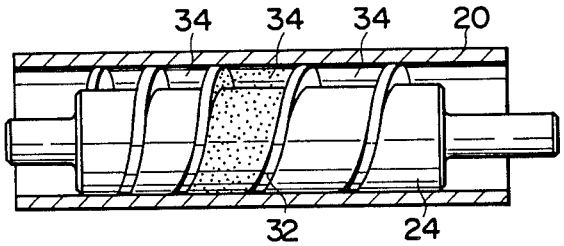
Figure 8E:
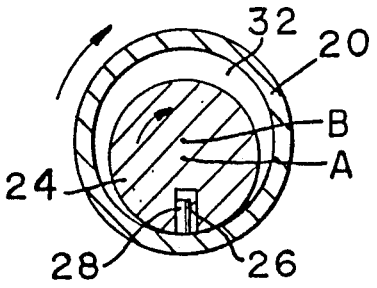
Figure 8F:
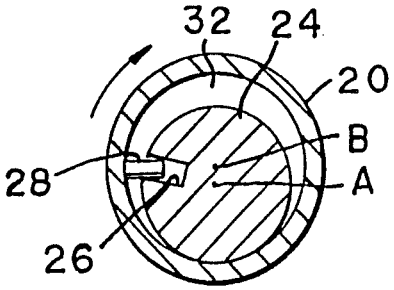
Figure 8G:
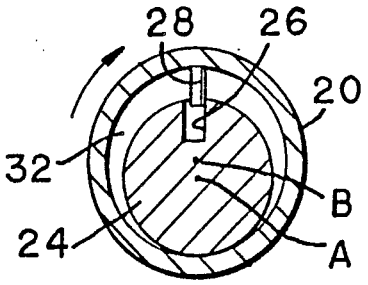
Figure 8H:
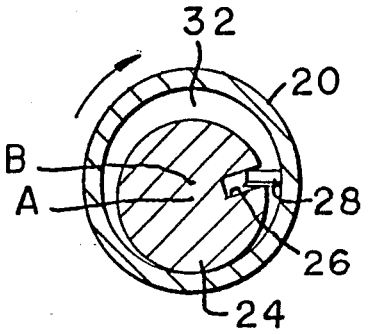

As is shown in FIGS. 1, 4, and 8E, engaging groove 26 is formed on the outer surface of the right end portion of rod 24 and extends in the axial direction of the rod. Groove 26 has a rectangular cross section with a width larger than the diameter of drive pin 28. Drive pin 28, which protrudes from the inner peripheral surface of cylinder 20, is fitted in groove 26 to be movable in the radial direction of the cylinder. Thus, as shown in FIGS. 8E to 8H when electric motor section 12 is energized to rotate cylinder 20 integrally with rotor 18, the rotatory force of the cylinder is transmitted to rod 24 through pin 28. As a result, rod 24 is rotated within cylinder 20 while the outer peripheral surface thereof is partially in contact with the inner peripheral surface of the cylinder.

As is shown in FIGS. 1 to 5, spiral groove 30, extending between the two opposite ends of rotating rod 24, is formed on the outer peripheral surface of rod 24. As is apparent from FIG. 2, groove 30, within which spiral blade 32 is fitted, is formed so that its pitches gradually become narrower with a distance from the right end of cylinder 20 to the left end thereof, that is, with a distance from the suction side of the cylinder to the discharge side thereof. Thickness t of blade 32 is substantially equivalent to the width of groove 30, and each portion of the blade is movable in the radial direction of rod 24 along the groove. The outer surface of blade 32 slides on the inner peripheral surface of cylinder 20 in tight contact therewith. Blade 32 is made of an elastic material, such as Teflon (Trademark), and can be fitted into groove 30 by utilizing its elasticity.

The space between the inner peripheral surface of cylinder 20 and the outer peripheral surface of rod 24 is divided into a plurality of operating chambers 34 by means of blade 32. Each chamber 34, which is defined between each two adjacent turns of blade 32, is substantially in the form of a crescent extending along the blade from a contact portion between rod 24 and the inner surface of cylinder 20 to the next contact portion. The volumes of operating chambers 34 are reduced gradually with a distance from the suction side of cylinder 20 to the discharge side thereof.

As is shown in FIGS. 1 and 4, bearing 21 is penetrated by suction hole 36 which extends in the axial direction of cylinder 20. One end of hole 36 opens into cylinder 20, and the other end thereof is connected to suction tube 38 of the refrigeration cycle. Discharge hole 40 extending along the axial direction of cylinder 20 is formed in bearing 22. One end of hole 40 opens into the discharge-side end of cylinder 20, while the other end thereof opens into the inner space of case 10. Inside rod 24, pressure introduction passage 42 extends inwardly from the right end of the rod along the central axis of the rod. The right end of passage 42 communicates with the inside of case 10, especially the bottom portion thereof, through bearing hole 21*b*, passage 44 formed in bearing 21, and pipe 45 connected to passage 44. The left end of passage 42 opens to the bottom of groove 30 on rod 24. Lubricating oil 41 is stored at the bottom of case 10. Thus, as the pressure inside case 10 increases, oil 41 is introduced through pipe 45, passage 44, bearing hole 21*b*, and passage 42 into the space between blade 32 and the bottom of groove 30. Pressure introduction passage 42 opens into groove 30 at a portion offset from the suction-side end of the groove toward the discharge side by a distance which is a little greater than one pitch of the groove.

In FIG. 1, reference numeral 46 denotes a discharge tube which communicates with the inside of case 10.

Figure 7:
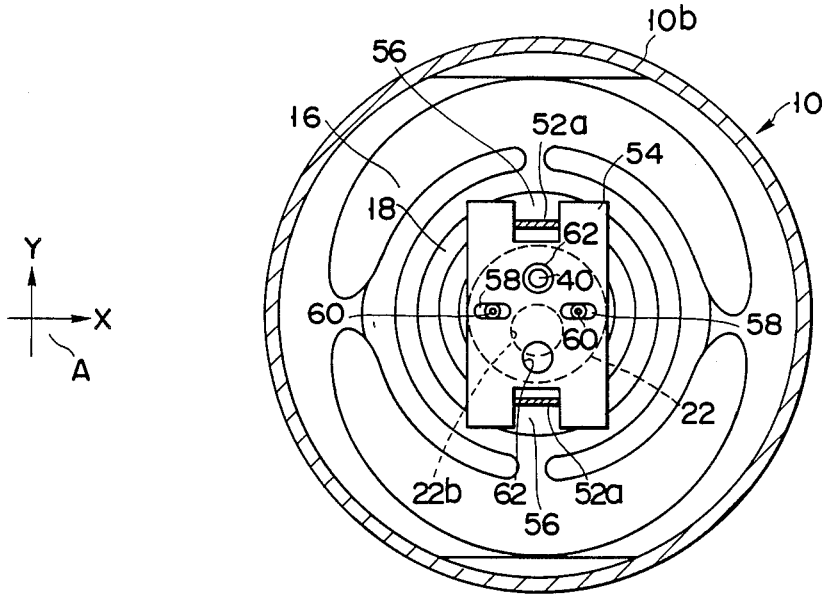

As described above, bearing 21 on the suction side is fixed to the inner surface of large-diameter portion 10*a* of case 10, whereas bearing 22 on the discharge side is supported on the inner surface of small-diameter portion 10*b* by support mechanism 48 so as to be movable in the radial direction of the cylinder. Support mechanism 48 includes elongated plate-like holding member 52 fixed to the inner surface of small-diameter portion 10*b* by a pair of pins 50, and rectangular leaf spring 54. Recesses 56 each having predetermined width W are formed in a pair of opposite edges of leaf spring 54, thereby forming a substantially H-shaped leaf spring. Holding member 52 has a width substantially equal to that of recess 56. Both the end portions of holding member 52 are bent inwardly toward the inside of case 10 to form bent portions 52*a*. Leaf spring 54 is fitted to holding member 52 while bent portions 52*a* are respectively inserted in recesses 56. As a result, leaf spring 54 is supported to be movable in the longitudinal direction of holding member 52, i.e., in the Y-coordinate direction in FIG. 7, but not rotatable. The distal end portion of each bent portion 52*a* is tapered so as to be easily inserted in corresponding recess 56. A pair of elongated holes 58 are formed in leaf spring 54. Elongated holes 58 extend in a direction perpendicular to the moving direction of the leaf spring, i.e., in the X-coordinate direction in FIG. 7, along a single straight line. A pair of projections 60 protrude from an end surface of bearing 22 and are located on a common circle, specifically, on a circle coaxial with cylinder 20. Projections 60 are respectively inserted in elongated holes 58 so as to be movable in the longitudinal direction of the elongated holes. Thus, bearing 22 is supported by leaf spring 58 to be movable with respect to the leaf spring in the X-coordinate direction while the pivotal motion of bearing 22 relative to the leaf spring is prevented by projections 60. Since leaf spring 54 is movable with respect to small-diameter portion 10*b* of case 10 in the Y-coordinate direction, bearing 22 is movable with respect to small-diameter portion 10*b* in the X- and Y-coordinate directions. That is, bearing 22 is supported by support mechanism 40 so as to be movable in the radial direction of cylinder 20.

In addition, spring 54 is cured so as to protrude toward bearing 22. Therefore, bearing 22 is biased by leaf spring 54 toward other bearing 21. Note that a pair of circular through holes 62 are formed in leaf spring 54. One of through holes 62 is opposite to discharge hole 40.

The operation of the compressor arranged in the above-described manner will be described.

When electric motor section 12 is energized, rotor 18 rotates, so that cylinder 20 rotates integrally therewith. At the same time, rotating rod 24 is rotated while its outer peripheral surface is partially in contact with the inner peripheral surface of cylinder 20. These relative rotatory motions of rod 24 and cylinder 20 are maintained by regulation means which includes pin 28 and engaging groove 26. Also, blade 32 rotates integrally with rod 24.

Blade 32 rotates in such a manner that its outer surface is in contact with the inner surface of cylinder 20. Therefore, each part of blade 32 is pushed into groove 30 as it approaches each contact portion between the outer surface of rod 24 and the inner surface of cylinder 20, and emerges from the groove as it goes away from the contact portion. When compression section 14 is actuated, refrigerant gas is sucked into cylinder 20 via suction tube 38 and suction hole 36. This gas is confined within operating chamber 34 which is located at the suction-side end. As rotating rod 24 rotates, as is shown in FIGS. 8A to 8D, the gas is transferred to operating chamber 34 on the discharge side while it is confined within the space between two adjacent turns of blade 32. Since the volumes of operating chambers 34 are reduced gradually with a distance from the suction side of cylinder 20, the refrigerant gas is compressed gradually as it is delivered to the discharge side. The compressed refrigerant gas is discharged into case 10 through discharge hole 40, which is formed in bearing 22, and is then returned to the refrigeration cycle through discharge tube 46.

When the pressure inside case 10 increases, moreover, lubricating oil 41 is introduced into the space between blade 32 and the bottom of groove 30 via pipe 45, passage 44, bearing hole 21*b*, and pressure introduction passage 42. Accordingly, blade 32 is continually urged to be pushed out from groove 30, that is, toward the inner peripheral surface of cylinder 20 by an oil pressure. During the operation of compression section 14, therefore, blade 32 can smoothly move in the radial direction of cylinder 20, without being caught by groove 30. Thus, the outer surface of blade 32 can always be kept in tight contact with the inner peripheral surface of cylinder 20. In this manner, operating chambers 34 are separated securely by blade 32, so that the gas can be prevented from leaking from between the operating chambers.

According to the compressor arranged in this manner, groove 30 of rod 24 is formed so that its pitches become gradually narrower with a distance from the suction side of cylinder 20 to the discharge side thereof. Thus, the volumes of operating chambers 34, which are separated by means of blade 32, are reduced gradually with a distance from the suction side of cylinder 20. Accordingly, the refrigerant gas can be compressed while it is being transferred from the suction side of cylinder 20 to the discharge side. Since the refrigerant gas is confined within operating chamber 34 while it is fed and compressed, it can be compressed highly efficiently even though no discharge valve is arranged on the discharge side of the compressor.

Since there is no need of a discharge valve, the components of the compressor can be reduced in number, so that the compressor can enjoy a simpler arrangement. Moreover, rotor 18 of electric motor section 12 is supported by cylinder 20 of compression section 14. It is unnecessary, therefore, to provide an exclusive-use rotating shaft and bearing for supporting the rotor. Thus, the number of components required can be reduced further, and the arrangement of the compressor can be made additionally simpler.

While the compressor is operating, moreover, an oil pressure is fed to the space between blade 32 and the bottom of groove 30, so that the blade is continually pressed toward the inner peripheral surface of cylinder 20. With this operation, blade 32 is rotated such that its outer surface is always in tight contact with the inner peripheral surface of cylinder 20. Accordingly, adjacent operating chambers 34 can be reliably separated to prevent gas leakage between them. In consequence, the gas can be compressed efficiently. Since blade 32 is urged against the inner peripheral surface of cylinder 20, it can be smoothly moved in groove 30 in the radial direction of the cylinder, tracing the inner peripheral surface thereof, even though the working accuracy of the components, such as the rectangularity of the blade, is not very high. Thus, the manufacture and assembling of the components can be facilitated.

Lubrication and sealing between the inner surface groove 30 and blade 32 can be effected by feeding high-pressure lubricating oil into the space between blade 32 and the bottom of groove 30. Since this interposal space extends spirally along groove 30, it as a hydraulic pump which can supply the lubricating oil to other sliding portions.

Cylinder 20 and rotating rod 24 are partially in contact with each other while they are rotated in the same direction. Therefore, the friction between these two members is so small that they can be rotated smoothly with less vibrations and noise.

The feeding capacity of the compressor depends on the first pitch of blade 32, that is, the volume of operating chamber 34 which is located at the suction-side end of cylinder 20. In this embodiment, the pitches of blade 32 gradually narrow with a distance from the suction side of cylinder 20. If the number of turns of blade 32 is fixed, therefore, the first pitch of the blade and hence, the feeding capacity of the compressor, according to this embodiment, can be made greater than the volume of a compressor whose blade has regular pitches throughout the length of its rotating rod. In other words, a high-efficiency compressor can be obtained.

If the number of turns of blade 32 is increased although the feeding capacity is reduced, then the difference in pressure between each two adjacent operating chambers decreases in inverse proportion. Thus, the amount of gas leaking between the operating chambers is reduced, so that the compressed efficiency is improved.

When the compressor having the above-described construction is to be assembled, first, electric section 12, cylinder 20, rotating rod 24, bearing 21, and the like are normally placed in large-diameter portion 10*a* of case 10. Then, small-diameter portion 10*b* of case 10 is coupled to large-diameter portion 10*a* by welding or the like together with other bearing 22. In an assembled state, the pair of bearings 21 and 22 must be concentrically arranged with high precision. This is because in order to efficiently perform compression, the position of rotating rod 24 relative to cylinder 20 must be maintained with high precision on the order of $\mu$, and at the same time they are required to be smoothly rotated with minimum friction. Assume that bearing 22 is fixed to the inner surface of small-diameter portion 10*b* of case 10. In this case, alignment between bearings 21 and 22 cannot be performed after small-diameter portion 10*b* is joined to large-diameter portion 10*a*. Therefore, in order to accurately match the axes of bearings 21 and 22 with each other, each member must be machined with very high precision in advance, and the assembling work must be performed with high precision. If the axes of bearings 21 and 22 are not coaxial with each other with high precision, the friction between each bearing and the cylinder, and between each bearing and the rotating rod is considerably increased, thereby interfering with smooth rotation of the cylinder and the rotating rod. In this case, a large drive force is required to rotate the cylinder. In addition, this causes generation of noise. Moreover, since the relative position of cylinder 20 and rotating rod 24 cannot be maintained with high precision, gas leakage and the like may occur. Consequently, the compressing efficiency of the compressor is decreased.

According to the embodiment, however, bearing 22 is supported on small-diameter portion 10*b* of case 10 by support mechanism 48 so as to be movable in the radial direction of cylinder 20. Therefore, after small-diameter portion 10*b* is joined to large-diameter portion 10*a* bearing 22 moves together with cylinder 20 and rotating rod 24 and is automatically aligned with bearing 21. Accordingly, alignment between bearings 21 and 22 is not required when the compressor is assembled, so that the assembling work is facilitated. In addition, since the axes of bearings 21 and 22 can be aligned with each other with high precision, high compression efficiency can be obtained, and a reduction in noise can be realized. Moreover, bearing 22 can be moved in the radial direction of the cylinder, and at the same time can be moved in the axial direction of the cylinder because of the effect of leaf spring 54 of support mechanism 48. With this arrangement, a dimensional error in manufacturing each member and a variation in positional tolerance can be compensated. Therefore, requirements for working precision of each part become less strict. As a result, the manufacturing cost can be decreased.

In the above embodiment, in place of leaf spring 54, a plate member having no biasing force may be used. Even in this case, bearing 22 can be supported so as to be movable in the radial direction of cylinder 20, and hence the axes of bearings 21 and 22 can be automatically aligned with each other.

Figure 9:
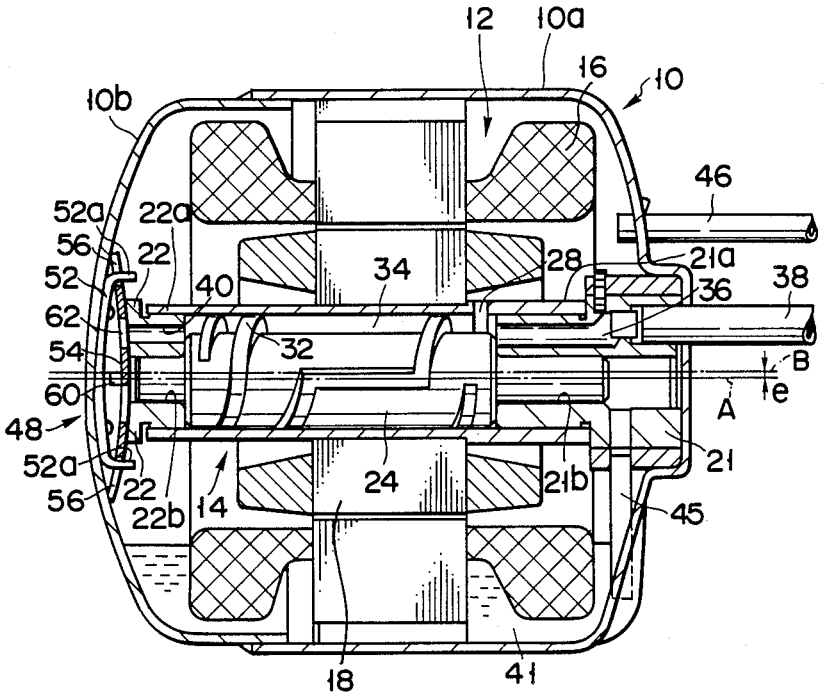
Figure 10:
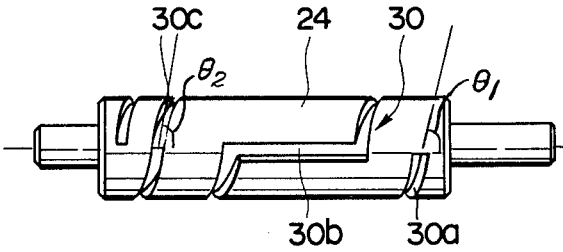
Figure 11:
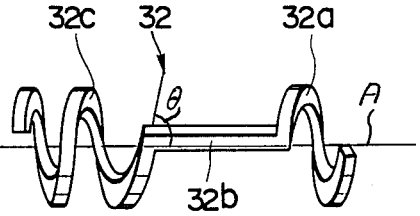

FIGS. 9 to 11 show a compressor according to a second embodiment of the present invention.

In the second embodiment, the constructions of groove 30 formed on rotating rod 24 and blade 32 are different from those in the first embodiment. Since other arrangements in the second embodiment are the same as those in the first embodiment, only the different points will be described in detail.

As described above, the transportation capacity of the compressor is determined by the initial pitch of blade 32, i.e., the volume of operating chamber 34 located on the suction-side end of cylinder 20. Therefore, a high-efficiency compressor can be realized by increasing the transportation capacity of gas by increasing the initial pitch of blade 32.

If the pitch of groove 30 is increased, however, blade 32 fitted therein is susceptible to great deformation. If blade 32 is greatly deformed, a large internal stress is generated in the blade. In addition, blade 32 is subjected to external forces such as a shearing force, a frictional force, and the like while the compressor is driven. For this reason, blade 32 must be made of a material which can withstand the stress and the external forces, and hence the material for the blade is limited. Furthermore, an operation of fitting blade 32 into groove 30 becomes difficult, and the blade cannot be smoothly actuated.

According to the second embodiment, a higher-efficiency compressor is realized without considerably increasing the pitches of groove 30 and blade 32.

As is apparent from FIGS. 9 and 10, the pitches of groove 30 formed in rotating rod 24 are gradually decreased with a distance from the suction-side toward the discharge-side of cylinder 20, as in the first embodiment. In addition, groove 30 comprises leading portion 30*a* formed at the suction-side end, intermediate portion 30*b* succeeding the leading portion, and trailing portion 30*c* extending from the intermediate portion to the discharge-side end of rod 24. Leading portion 30*a* extends from the suction-side end of rod 24 by about one turn and defines about angle $\Theta_1 90°$ with the axial direction A of the rod. The above angle $\Theta_1$ of leading portion 30*a* is preferably set to be within the range of more than 45° to less than 90°. Intermediate portion 30*b* extends from the distal end of leading portion 30*a* in a direction substantially parallel to the axis of rod 24 by a predetermined length. The angle of intermediate portion 30*b* with respect to the axial direction A of rod 24 is preferably set to be less than 45°. Trailing portion 30*c* extends from the distal end of intermediate portion 30*b* to the discharge-side end of rod 24 by a plurality of turns. The angle $\Theta_2$ of trailing portion 30*c* with respect to the axial direction A rod 24 is set to be gradually increased toward the discharge-side end of rod 24, and is within the range of more than 45° to less than 90°. These leading, intermediate, and trailing portions are continuously formed without crossing each other.

As is shown in FIG. 11, spiral blade 32 is formed to correspond to groove 30, and comprises intermediate portion 32*b* extending substantially parallel to the central axis of the blade, and leading and trailing portions 32*a* and 32*c* inclined at an angle $\Theta$ of substantially 90° with respect to the central axis A. Portions 32*a*, 32*b*, and 32*c* of the blade are slidably fitted in corresponding portions 30*a*, 30*b*, and 30*c* of groove 30, respectively.

According to the second embodiment arranged in the above-described manner, intermediate portion 30*b* of groove 30, and intermediate portion 32*b* of blade 32 extend substantially parallel to the axis of rotating rod 24. For this reason, the first operating chamber located on the suction-side end of cylinder 20, i.e., the chamber defined by leading portion 32*a*, intermediate portion 32*b*, and the first turn of trailing portions 32*c* of the blade, has a very large volume compared with the first embodiment. Therefore, the transportation capacity of gas is large, and a large amount of fluid can be compressed within a short period of time. Consequently, the compression efficiency of the compressor is increased.

Generally, when groove 30 is tilted at 45° with respect to the axis of rotating rod 24, a deformation amount of blade 32 fitted in the groove is greatest. As the tilt angle of groove 30 with respect to rod 24 approaches 90° or 0°, the deformation amount of blade is decreased. As described above, leading and trailing portions 30*a* and 30*c* of groove 30 are tilted at an angle larger than 45° and close to 90° with respect to the axis of rotating rod 24, and intermediate portion 30*b* extends substantially parallel to the axis of rod 24. With this arrangement, blade 32 fitted in groove 30 is not greatly deformed, and only a small internal stress is generated in the blade. Therefore, the mechanical strength of the blade need not be very high. As a result, the material used for the blade can be selected relatively freely, and the service life of the blade can be prolonged. In addition, since the deformation amount of blade is small, the blade can smoothly slide in groove 30, and gas leakage and the like can be reliably prevented.

As described above, according to the second embodiment, in addition to the effects in the first embodiments, it is possible to improve the compression efficiency of a compressor without greatly deforming the blade.

It is noted that the present invention is not limited to the above-described embodiments, and various changes and modifications may be made without departing from the scope and spirit of the invention. For example, the present invention may be applied to compressors other than those used in refrigeration cycles. Furthermore, in the above embodiments, oil stored in case 10 is supplied to the bottom of groove 30 so that blade 32 is urged against the inner peripheral surface of cylinder 20. However, the same effects as in the above embodiments can be obtained by introducing part of compressed gas, which discharged into case 10, into groove 30 instead of using the oil.

What is claimed is:

1. A fluid compressor comprising:

a cylinder having a suction-side end and a discharge-side end;

a columnar rotating body located in the cylinder to extend in the axial direction thereof and be eccentric thereto, and rotatable relative to the cylinder while part of the rotating body is in contact with the inner peripheral surface of the cylinder, said rotating body having a spiral groove on the outer peripheral surface thereof, said groove having pitches narrowed gradually with a distance from the suction-side end to the discharge-side end of the cylinder;

a spiral blade fitted in the groove to be slidable, substantially in the radial direction of the rotating body, having an outer surface in tight contact with the inner peripheral surface of the cylinder, and dividing the space between the inner peripheral surface of the cylinder and the outer peripheral surface of the rotating body into a plurality of operating chambers;

a pair of bearings for rotatably supporting both ends of the cylinder and rotatably supporting corresponding ends of the rotating body so as to hold the rotating body at a predetermined position with respect to the cylinder;

drive means for relatively rotating the cylinder and the rotating body so as to sequentially transporting a fluid, which is drawn into the cylinder from the suction-side end thereof, toward the discharge-side side of the cylinder through the operating chambers;

a closed case for housing said constituent members; and support means for supporting one of said bearings so as to be movable in the radial direction of the cylinder relative to the case.

2. A compressor according to claim 1, wherein said support means includes a holding member fixed to the inner surface of said case, and a movable member supported by the holding member so as to be linearly movable within a plane perpendicular to the axis of the cylinder, and said one bearing is supported by the movable member so as to be movable in a direction perpendicular to the moving direction of the movable member.

3. A compressor according to claim 2, wherein said moving member is a plate member and has a pair of elongated through holes extending in a direction perpendicular to the moving direction thereof, and said one bearing includes an end face which is in contact with the moving member and a pair of projections protruding from the end face and movably inserted in the through holes, respectively.

4. A compressor according to claim 2, wherein said moving member is a plate member, and includes a pair of opposite recesses, and said holding member includes a pair of engaging portions extending from the inner surface of the case toward said one bearing and respectively inserted in the corresponding recesses.

5. A compressor according to claim 2, wherein said moving member is formed of a leaf spring which is arranged to elastically deformable in the axial direction of the cylinder and which urges said one bearing toward the other bearing.

6. A compressor according to claim 1, wherein each of said bearings includes a peripheral surface on which an end portion of the cylinder is rotatably fitted and a bearing hole in which an end portion of the rotating body is rotatably inserted.

7. A compressor according to claim 1, wherein said case includes a first section and a second section fixed thereto, said drive means is arranged in the first section, said other bearing is fixed to an inner surface of the first section, and said support means is arranged between said one bearing and the second section.

8. A compressor according to claim 1, wherein said bearing which supports the suction-side end of the cylinder includes a suction hole for introducing a fluid from the outside of the case into the suction-side end of the cylinder, and said bearing which supports the discharge-side end of the cylinder includes a discharge hole for discharging the fluid compressed in the cylinder into the case.

9. A compressor according to claim 1, wherein said groove of the rotating body includes a leading portion located at the suction side of the cylinder, a trailing portion located on the discharge side thereof, and an intermediate portion located between the leading and trailing portions, the leading and trailing portions being tilted at an angle within a range of more than 45° to less than 90° with respect to the axial direction of the rotating body, and the intermediate portion being tilted at an angle of less than 45° with respect to the axial direction of the rotating body.

10. A compressor according to claim 9, wherein said intermediate portion extends substantially parallel to the axis of the rotating body.

11. A compressor according to claim 1, further comprising pressurizing means for pressurizing a space between a bottom of the groove and the blade so as to urge the blade against the inner peripheral surface of the cylinder.

12. A compressor according to claim 11, wherein said pressurizing means includes means for supplying compressed oil in the space between the bottom of the groove and the blade.

13. A compressor according to claim 12, wherein said supply means includes an oil introduction passage formed in the rotating body, and guide means for guiding the compressed oil into the oil introducing passage, the introduction passage having one end open to an end of the rotating body and the other end open to the bottom of the groove.

14. A compressor according to claim 13, wherein said supply means includes lubricating oil stored in a bottom portion of the case, and said guide means includes one end communicating with said one end of the oil introducing passage and the other end open to the lubricating oil.

15. A compressor according to claim 1, wherein said drive means comprises an electric motor section for rotating the cylinder, and transmitting means for transmitting a rotatory force of the cylinder to the rotating body and rotating the rotating body in synchronism with the cylinder.

16. A compressor according to claim 5, wherein said electric motor section includes a rotor fixed to the outer peripheral surface of the cylinder, and a stator arranged outside the rotor.

17. A compressor according to claim 5, wherein said transmitting means includes an engaging groove formed in the outer peripheral surface of the rotating body, and a projection which extends from the inner surface of the cylinder and is inserted in the engaging groove to be movable in the radial direction of the cylinder.

* * * * *